US007678979B1

(12) United States Patent
Roop

(10) Patent No.: US 7,678,979 B1
(45) Date of Patent: Mar. 16, 2010

(54) RESONANCE MODULATOR

(76) Inventor: Mat Roop, P.O. Box 553, Wyoming (CA) N0N 1T0

( * ) Notice: Subject to any disclaimer, the term of this patent is extended or adjusted under 35 U.S.C. 154(b) by 0 days.

(21) Appl. No.: 12/288,885

(22) Filed: Oct. 24, 2008

Related U.S. Application Data

(60) Provisional application No. 60/996,841, filed on Dec. 7, 2007.

(51) Int. Cl.
*G10D 3/04* (2006.01)

(52) U.S. Cl. ..... 84/309; 84/267

(58) Field of Classification Search ..... 84/267, 84/291, 309
See application file for complete search history.

(56) References Cited

U.S. PATENT DOCUMENTS 2,087,106 A * 7/1937 Hart ..... 84/727

* cited by examiner

*Primary Examiner*—Kimberly R Lockett

(57) ABSTRACT

A magnetic resonance modulator system for acoustic stringed musical instruments having a plurality of magnets. The resonance modulation is a function of the plurality of weights and locations of placement of magnets on the instrument. The attachment of the resonance modulator to the instrument and its infinite adjustability is achieved by using the attractive magnetic forces of the magnets to hold them in place through a vibrating component of the instrument, in any position on the instrument, making any location adjustment and consequent resonance or tonal adjustment quick and easy.

3 Claims, 1 Drawing Sheet

RESONANCE MODULATOR

This non-provisional patent application corresponds to the provisional patent No. 60/996,841 with a filing date of Dec. 7, 2007 and confirmation #1030

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The invention relates to apparatus and means to modulate the resonance of an acoustic musical string instrument such as, for example, one from the violin family including instruments commonly called a violin, viola, cello or bass.

Stringed acoustic musical instruments, of which violins, violas, cellos and basses are examples, have a tone that is uniquely characteristic to the instrument. Instrument tone is a function of the construction, design, and materials used in the production of the instrument. As a result each instrument has a unique tone. Disadvantageously, an instrument may inherently produce a wolf note or tone that is not entirely satisfactory to the player.

There are many devices and procedures available to vary the tone of the instrument. Weight or mass devices are available for attachment to the instrument in areas such as string after-length, the bridge, or tailpiece. The efficacy of these devices is affected by the limited areas available on the instrument for their attachment thus limiting the adjustability available.

In some cases permanent weight/mass attachments may be fastened to the inside of the instrument. In other cases, material may be permanently removed from the inside of the instrument, from the bridge, tailpiece, or fingerboard. In cases of permanent alterations, the effect of the change is not known until after the changes are made which is a hit and miss proposition. If the resulting tone is not as anticipated or desired, then the change cannot be easily undone and requires restoration.

In all cases of material attachment or removal, the changes may negatively affect the overall tone of the instrument even though the specific tone deficiency may be successfully brought under control. As well, different varieties of strings may also be used to achieve different tone. However, strings tend to be costly and testing many different strings can be detrimental to the instrument as well as time consuming and costly.

There is therefore a need for a simple device that can be removably and be widely adjustably attached to the instrument, in order to effectively modulate the resonance characteristic of an instrument to suit the pleasure of different players or different music scores, such that it does not damage or alter the material or finish of the instrument.

BRIEF SUMMARY OF THE INVENTION

The resonance modulator as claimed is intended to provide a simple yet effective and infinitely adjustable device that is as easily attached to the instrument as it is removed and will not permanently alter the instrument in any way. The resonance modulator consists of an inner magnet assembly and an outer magnet assembly, each holding each other in place through the vibrating plate or component of the instrument by their magnetic forces. The mass of the magnets, while in place, alter the mass distribution of the vibrating instrument plate, and consequently the tone of the instrument is changed. Simply sliding the outer magnet assembly to a different location will cause the inner magnet to follow and will consequently create a different mass distribution of the plate and a respective difference in instrument tone.

BRIEF DESCRIPTION OF THE SEVERAL VIEWS OF THE DRAWING

In order that the invention may be more clearly understood, embodiments thereof will now be described in detail by way of example with reference to the accompanying drawings.

FIG. 2 cross sectional view also shows for reference purposes key acoustic components of a traditional violin including a portion of the bridge 6, soundpost 8, bass bar 9, instrument rib 10 and back plate 11.

DETAILED DESCRIPTION OF THE INVENTION

Figure 1:
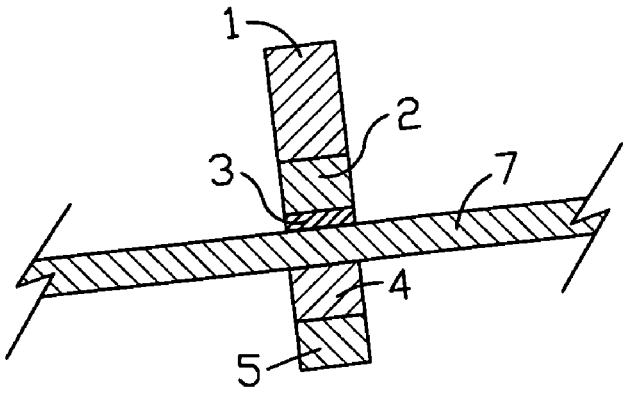
FIG. 1 is an enlarged cross sectional view taken from FIG. 2 showing the resonance modulator apparatus, comprised of parts 1, 2, 3, 4 and 5 in situ on opposite sides of the top plate 7 of the instrument body.
Figure 2:
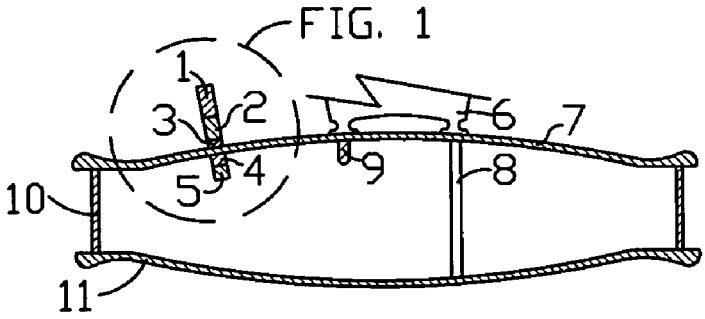
FIG. 2 is a cross sectional view taken at 2-2 of FIG. 3 of a violin showing the resonance modulator of FIG. 1 attached thereto.
Figure 3:
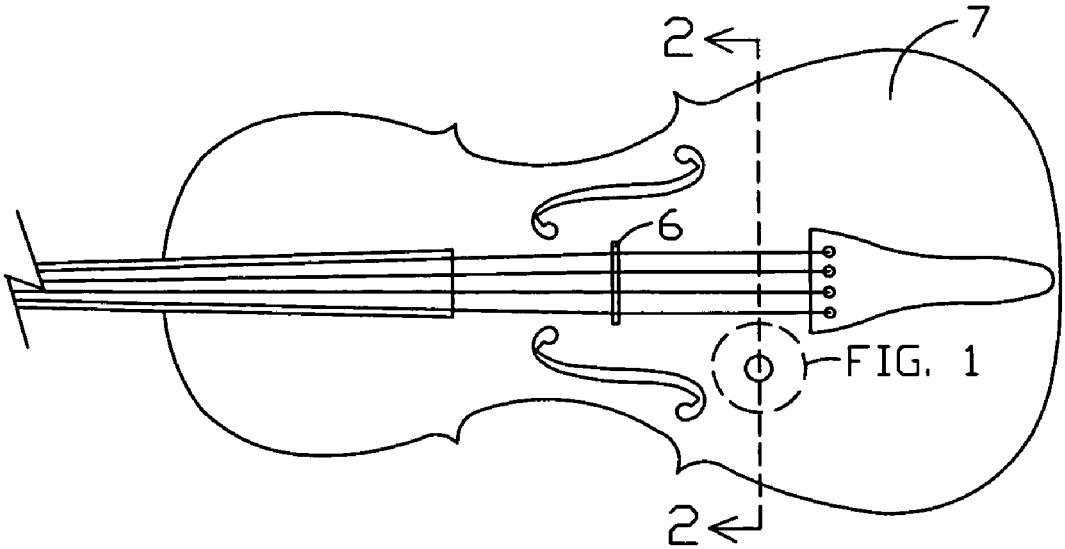
FIG. 3 is a plan view of a violin showing the resonance modulator of FIG. 1 in situ.

The resonance modulator apparatus according to this invention consists of one or more discrete magnets acting in combination with one or more discrete magnetically attractive metal weights and or discrete magnets all of which are magnetically attached to one another in longitudinal alignment across the vibrating plate of the body of a string instrument. FIGS. 1, 2 and 3 represent only one of a plurality of sizes and locations possible.

Referring to FIG. 1, a resonance modulator as claimed in cross section of the instrument consisting of parts 1, 2, 3, 4 and 5 in situ across opposing sides of vibrating plate 7.

Referring to FIG. 1, an outer magnet assembly consisting of parts 1, 2 and 3 is shown exterior of the body of the violin in cross section of the instrument which is magnetically attached to the inner magnet assembly consisting of 4 and 5 which is interior of the instrument.

Referring to FIG. 1, the outer magnet assembly consists of one or more discrete magnets indicated in this example as 1 and 2 with a protective liner 3 adhered to magnet 2 between the outer magnet assembly and instrument body 7. The inner magnet assembly consists of one or more discrete magnets indicated in this example as 4 and 5 which are magnetically attached and held in place by the outer magnet assembly 1 and 2 through the vibrating plate of the instrument body top plate 7. It is to be noted that one or more of the magnets can be substituted with magnetically attractive weights which is advantageous in cases where metal parts interior to the instrument may undesirably attract the magnets during the process of installation or adjustment.

FIG. 2 shows in cross section the resonance modulator apparatus in situ across the vibrating top plate of the instrument body. Magnet 1 and 2 weight/mass can be of any suitable size and shape which is finger graspable and can be moved across the instrument body as required for the desired effect. The functional weight/mass of the resonance modulator is a function of the number and size of magnets or weights used to finally configure the entire assembly. It is to be noted that once the initial magnetic connection has been made, the resonance modulator apparatus can be moved by moving the outer magnet assembly 1 and 2 which results in the movement of the inner magnet assembly 4 and 5 in a following sense so that various adjustments can be easily and quickly made across substantially the entire surface area of the instrument.

The liner 3 serves to protect the surface of the instrument and resist undesirable movement due to instrument vibration. The liner can be made of soft grain leather or other protective and slip resistant material. The soft grain leather provides scratch resistant protection for the instrument finish when the apparatus is moved and also provides an element of slip resistance to resist movement by reason of the vibration of the instrument when played. In practice, one side of the soft grain leather 3 can be adhesively attached to the bottom of one of the magnets 2 comprising the outer magnet assembly.

The placement of the resonance modulator has the effect of altering the mass of the vibrating plate of the instrument body at the placement point which results in a change in the resonance of the instrument. As described, different placement points may be selected to variably adjust for the desired overall end tone. The musician can thus experiment with varying weights and placement locations to find the best weight and location combination for the resonance modulator in order to achieve the desired effect. The resonance modulator apparatus according to this invention can be sold in kits of different and various shapes, sizes and colors to enable the user to make a variety of adjustments in furtherance of obtaining the most desirable tone as well as aesthetics.

Other advantages which are inherent to the apparatus are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

I claim:

1. A resonance modulator attachment for acoustic string musical instruments, namely the violin, viola, cello, bass, guitar, mandolin, banjo, dulcimer, harp, lute and zither, comprising of the mass of a plurality of magnets, attached magnetically, in longitudinal alignment on opposing sides of the vibrating components of the named instruments, for the purpose of modulating the mass distribution of the vibrating components resulting in the modulation of the resonance and tone of the instrument to which it is attached.

2. A resonance modulator attachment for acoustic string musical instruments, namely the violin, viola, cello, bass, guitar, mandolin, banjo, dulcimer, harp, lute and zither, comprising of the mass of a plurality of magnets and magnetically attractive weights, attached magnetically, in longitudinal alignment on opposing sides of the vibrating components of the named instruments, for the purpose of modulating the mass distribution of the vibrating components resulting in the modulation of the resonance and tone of the instrument to which it is attached.

3. A resonance modulator attachment for acoustic string musical instruments, namely the violin, viola, cello, bass, guitar, mandolin, banjo, dulcimer, harp, lute and zither, comprising of the mass of a plurality of magnets and magnetically attractive weights, attached magnetically, in longitudinal alignment on opposing sides of the vibrating components of the named instruments, a protective scratch resistant and slip resistant liner of leather, rubber or plastic adhered to the magnet separating the magnet from the exterior finish of the instrument, for the purpose of modulating the mass distribution of the vibrating components resulting in the modulation of the resonance and tone of the instrument to which it is attached.

* * * * *